United States Patent [19]

Gutmann et al.

[11] 4,422,442

[45] Dec. 27, 1983

[54] WARMING JUG

[75] Inventors: Franz Gutmann, Rebstein; Peter Sieber, Widnau, both of Switzerland

[73] Assignee: Platson AG Kunststoffwerke Hans Frei & Sohne, Widnau, Switzerland

[21] Appl. No.: 275,495

[22] Filed: Jun. 22, 1981

[30] Foreign Application Priority Data

Oct. 28, 1980 [CH] Switzerland ..... 8014/80

[51] Int. Cl.[3] ..... A47J 27/00

[52] U.S. Cl. ..... 126/390; 126/373; 220/4 C; 220/4 D; 220/94 A

[58] Field of Search ..... 126/373, 390; 220/4 C, 220/4 D, 4 R, 94 A, 469; 222/143, 465 A, 465 R; 206/602, 487; 215/200, 329, 343, 344, 350; 16/116 R

[56] References Cited

U.S. PATENT DOCUMENTS

| | | | |
|---|---|---|---|
| 2,197,141 | 4/1940 | Belden | 222/465 R |
| 2,326,414 | 8/1943 | Thompson | 220/4 D |
| 3,606,102 | 6/1969 | Lowry et al. | 222/465 A |

FOREIGN PATENT DOCUMENTS

| | | | |
|---|---|---|---|
| 2824653 | 5/1979 | Fed. Rep. of Germany . | |
| 1545867 | 10/1968 | France | 220/4 C |
| 943182 | 12/1963 | United Kingdom | 220/4 C |
| 1252071 | 11/1971 | United Kingdom | 222/465 A |

*Primary Examiner*—Samuel Scott
*Assistant Examiner*—Randall L. Green
*Attorney, Agent, or Firm*—Yount & Tarolli

[57] ABSTRACT

The warming jug consists of a jacket (1) of several parts and a metal bottom (2). Parts of the jacket (1) are: an upper section (3) with a handle (15), an intermediate ring (5) and a closing ring (7). The metal bottom (2) is arranged in a circular groove (10) between the closing ring (7) and the intermediate ring (5). To ensure tightness, an additional seal (13) is arranged between the border of the bottom (6) and the intermediate ring (5) or the closing ring (7). The jacket parts (3, 5 and 7) are made of synthetic and are bonded together to one unit.

6 Claims, 3 Drawing Figures

WARMING JUG

BACKGROUND OF THE INVENTION

The invention relates to a warming jug to be put on a warming plate with a metal bottom and a jacket in another material.

Warming jugs of this kind are known, e.g., from the German Patent Application No. 2 824 653.9. They serve to keep liquids, food and the like at a constant temperature, by putting the jug on a warming plate. Containers being made entirely of metal are subject to certain restrictions in view of their form as well as of weight reasons. There is, therefore, a requirement to produce such containers in non-metallic materials, which permit a free shaping and are of light weight. Such materials, however, can in most cases not be put in direct contact with warming plates and besides do not have thermal conductivity. Therefore, the jug jacket of the known warming jug is connected with a metal bottom.

The connection of these two different materials in one jug leads to considerable problems in construction and production technique. The jacket of the known warming jug, therefore, must be especially shaped at its lower end portion, i.e., the thickness of the jacket must be increased and shaped by special methods. For the shaping of this part of the jacket very expensive and complicated tools are needed. This leads to high production costs for such warming jugs.

SUMMARY OF THE INVENTION

It is object of this invention to provide a warming jug which has a metal bottom and a jacket of a non-metallic material, e.g., a synthetic material, whereby the connection between the bottom and the jacket is shaped in a way that the forming of the outer shape of the jug is not restricted and simple production tools can be used.

The warming jug according to this invention is distinguished by the fact that the jacket consists of an upper part, an intermediate ring between the lower end of the upper part and the metal bottom and a closing ring situated beneath the outer part of the metal bottom, and that all three parts of the jacket are being made of a synthetic material.

The connection between the three jacket parts is made in a way that the intermediate ring has a guiding element in the form of a circular groove or an annular raising to accept the lower end of the upper part. The closing ring has a pair of circular grooves one to accept the lower part of the intermediate ring and one to accept the outer part of the metal bottom. A fluid tight connection of the three parts of the jacket is achieved in sealing them together.

Because of the differences in the coefficients of thermal expansion of the jug jacket and the metal bottom, these parts cannot be connected directly. This problem is solved by arranging a seal ring between the border of the metal bottom and the areas of the intermediate ring and/or the closing ring. In the intermediate ring and/or the closing ring, a groove is arranged to accept this seal ring. Thereby, the metal bottom can expand independently of the expansion of the jug.

In order to prevent a contact of the surfaces of the hand with the hot surface of the jug, it is advantageous to form the jug with an additional heat insulation rib in the portion of the jacket adjacent the handle.

In this arrangement of the jug, the jacket part of the warming jug can be shaped according to the desires of the designer or the user of the jug. Simple tooling can be used, since there are no special requirements for the connection with the metal bottom. The production of the intermediate ring is also very easy, since the form of a ring can also be obtained with simple tools. In changing the shape of the intermediate ring, adjustments to various requirements can be met without changing the main parts of the warming jug, viz. the upper part of the jacket and the metal bottom. For example, jugs of different heights can be produced by changing the height of the intermediate ring. This represents a considerable reduction of production cost.

BRIEF DESCRIPTION OF THE DRAWINGS

An embodiment of the invention will now be described by way of example with reference to the accompanying drawings in which.

DESCRIPTION OF PREFERRED EMBODIMENT

Figure 1:
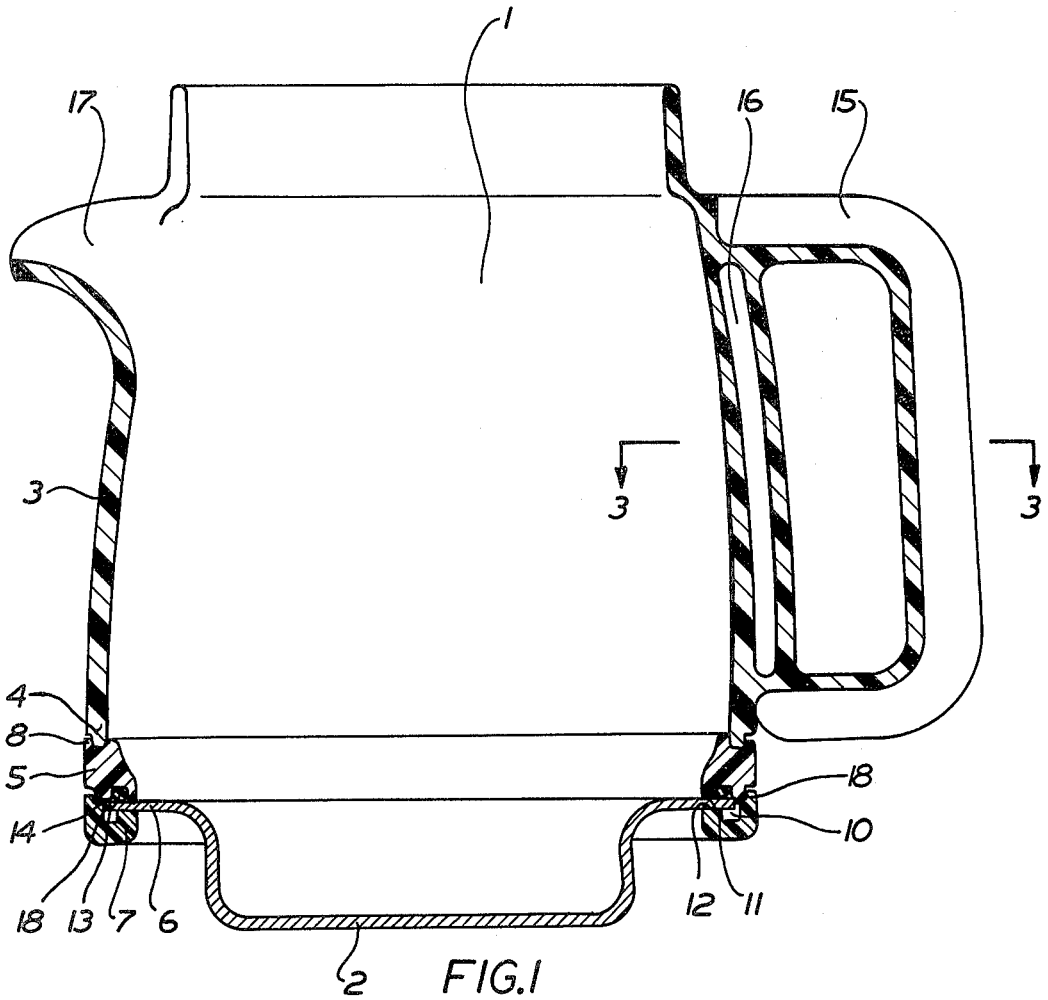
FIG. 1 is a view of a warming jug constructed according to the present invention.
Figure 3:
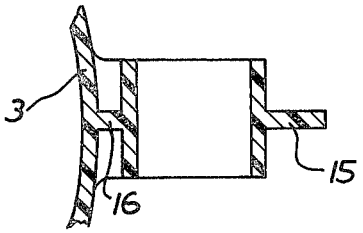
FIG. 3 is a sectional view taken along line 3—3 of FIG. 1.
Figure 2:
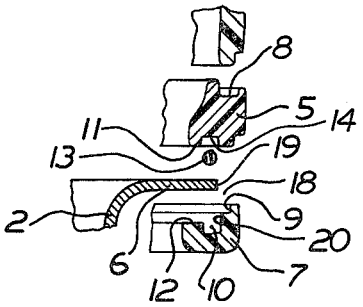
FIG. 2 is an enlarged exploded view of a portion of FIG. 1.

A warming jug constructed in accordance with the present invention consists of a jacket 1 which is equipped with a spout 17 and a handle 15. An intermediate ring 5 is connected with the lower end 4 of the jacket 1, to which the radially outer portion 6 of the bottom 2 is adjacent. Beneath the outer portion 6 of the bottom 2 a closing ring 7 is arranged, which encloses the outer section 6 of the bottom 2 and is connected with the intermediate ring 5.

The intermediate ring 5 has a guiding groove in form of a circular groove 8, which receives the lower end 4 of the jacket 1. The closing ring 7 has two circular grooves 9 and 10, arranged in the form of steps. The circular groove 9 receives the intermediate ring 5, and the circular groove 10 receives the outer portion 6 of the bottom 2. In connecting this way the three parts 1, 5 and 7, a straight course from the jacket down to the bottom section is reached.

If the three parts jacket 1, intermediate ring 5 and closing ring 7 are being made of a synthetic material, they can be connected together in the section of the circular groove 8 and the circular groove 9 by means of an ultrasonic welding process. Thereby, a completely tight connection of the three parts is reached. When choosing other materials and even when using synthetic materials, the three parts can also be glued together or be connected in another way.

Before bonding the closing ring 7 with the intermediate ring 5, the bottom 2 is introduced so that the radially outer portion 6 of the bottom 2 is positioned between annular surface 11 of the intermediate ring 5 and annular surface 12 of the closing ring. The surfaces 11 and 12 clamp the bottom 2 in place when the jug 1 is assembled. The diameters of the circular groove 10 and the bottom 2 are selected so that an annular gap 18 occurs between the outer perimeter 19 of the bottom 2 and the inner perimeter 20 of the groove 10. This annular gap 18 accommodates the differences in the rates of thermal expansion of the bottom 2 and the closing ring 7 as well as the intermediate ring 5.

The steam and liquid tight connection between the intermediate ring 5 and the bottom 2 is guaranteed through a seal ring 13 which is arranged in a circular groove 14 in the intermediate ring 5. This seal ring 13 prevents the penetration of liquids and steam and allows the bottom 2 to expand. The groove 14 is shown formed in the intermediate ring 5, it could also be formed in the surface 12 of the clamping ring 7.

If different models of the warming jug are to be made with a bottom configured differently from the bottom 2, the jacket 1 does not have to be changed, only the intermediate ring 5 or the closing ring 7 need be altered. Similarly, if a warming jug model with a different overall height is to be made, a taller intermediate ring 5 can be used without difficulties. This may be necessary if such warming jugs are to be used with coffee machines, since the height between warming plate and water inflow is varies between brands of such machines.

Adjacent the handle 15 is a heat insulation rib 16. The rib 16 is integrally formed with the jacket 1. This rib 16 is T-shaped and protects the hand of a user from contacting the warm surface of the jacket 1 when picking up the jug.

What is claimed is:

1. A warming jug adapted to be placed on a warming plate, said jug comprising a synthetic main body defining at least partially an interior cavity in said warming jug, said main body having a main portion and a lower end portion, a metal bottom forming the bottom of said cavity, a synthetic intermediate ring member located between said main body and said metal bottom and connected with said lower end portion of said main body, a synthetic closure ring member connected with said synthetic intermediate ring member, said metal bottom having a central portion located below said closure ring member, and said synthetic intermediate ring member and closure ring member having opposed faces clampingly engaging opposite surfaces of the outer portion of said metal bottom therebetween which outer portion is located at the perimeter of said metal bottom.

2. A warming jug as set forth in claim 1, wherein said synthetic intermediate ring member includes a portion on the upper surface thereof for interfitting with said lower end portion of said main body, the thickness of said lower end portion being not greater than the maximum thickness of said main portion of said main body.

3. A warming jug as set forth in claim 1, wherein said synthetic closure ring member includes an upper groove for receiving a portion of said synthetic intermediate ring member, and a lower groove for receiving the outer portion of said metal bottom.

4. A warming jug as set forth in claim 3, wherein one of said ring members has a groove in which a sealing ring is located for sealing contact with said bottom plate.

5. A warming jug as set forth in claim 1, wherein said main body, said synthetic intermediate ring member and said synthetic closure ring member are ultrasonically welded together.

6. A warming jug as set forth in claim 1, wherein said warming jug includes a handle connected to the main body and adapted to be gripped by a hand, and a rib extending between said main body and said handle adjacent said handle for preventing contact between the hand gripping said handle and said main body.

* * * * *

UNITED STATES PATENT AND TRADEMARK OFFICE

CERTIFICATE OF CORRECTION

PATENT NO. : 4,422,442
DATED : December 27, 1983
INVENTOR(S) : Franz Gutmann and Peter Sieber It is certified that error appears in the above-identified patent and that said Letters Patent are hereby corrected as shown below:

Item [73] on title page should read:

Plaston AG Kunststoffwerke Hans Frei & Sohne,
Widnau, Switzerland

Signed and Sealed this
*Third* Day of *July 1984*

[SEAL]

*Attest:*

GERALD J. MOSSINGHOFF

*Attesting Officer*

*Commissioner of Patents and Trademarks*